US008945354B2

(12) United States Patent
Williamson et al.

(10) Patent No.: US 8,945,354 B2
(45) Date of Patent: Feb. 3, 2015

(54) CATHODE SCRAPER SYSTEM AND METHOD OF USING THE SAME FOR REMOVING URANIUM

(75) Inventors: Mark A. Williamson, Naperville, IL (US); Stanley G. Wiedmeyer, Glen Ellyn, IL (US); James L. Willit, Batavia, IL (US); Laurel A. Barnes, Chicago, IL (US); Robert J. Blaskovitz, Lockport, IL (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 0 days.

(21) Appl. No.: 13/335,209

(22) Filed: Dec. 22, 2011

(65) Prior Publication Data

US 2013/0160797 A1 Jun. 27, 2013

(51) Int. Cl.
*C25C 7/08* (2006.01)
*C25C 3/34* (2006.01)

(52) U.S. Cl.
USPC ..... 204/242; 205/47; 205/367

(58) Field of Classification Search
CPC ..... C25C 7/08; C25C 3/00; C25C 3/34; C25C 7/005
USPC ..... 204/247.2, 242; 205/43–49, 363, 367
See application file for complete search history.

(56) References Cited

U.S. PATENT DOCUMENTS

| | | | |
|---|---|---|---|
| 422,139 | A | 2/1890 | Maxon |
| 2,089,738 | A | 8/1935 | Elmer |
| 2,194,444 | A | 3/1940 | Hulse et al. |
| 2,800,219 | A | 7/1957 | Carroll |
| 2,913,380 | A | 11/1959 | Gullett |
| 3,531,269 | A | 9/1970 | Grady |
| 3,562,131 | A | 2/1971 | Jasberg |
| 3,645,708 | A | 2/1972 | Grady |
| 3,697,404 | A | 10/1972 | Paige |
| 3,972,794 | A | 8/1976 | Lamm |
| 4,013,329 | A | 3/1977 | Hugin |
| 4,023,673 | A | 5/1977 | Hansen |
| 4,025,400 | A | 5/1977 | Cook et al. |
| 4,039,403 | A | 8/1977 | Astley et al. |

(Continued)

FOREIGN PATENT DOCUMENTS

| | | |
|---|---|---|
| AU | 622994 | 4/1992 |
| CA | 1 142 123 | 3/1983 |

(Continued)

OTHER PUBLICATIONS

International Search Report dated Jan. 20, 2012 issued in PCT/US2011/053589.

(Continued)

*Primary Examiner* — Harry D Wilkins, III
*Assistant Examiner* — Ciel Thomas
(74) *Attorney, Agent, or Firm* — Harness, Dickey & Pierce, P.L.C.

(57) ABSTRACT

Embodiments include a cathode scraper system and/or method of using the same for removing uranium. The cathode scraper system includes a plurality of cathode assemblies. Each cathode assembly includes a plurality of cathode rods. The cathode scraper system also includes a cathode scraper assembly configured to remove purified uranium deposited on the plurality of cathode rods. The cathode scraper assembly includes a plurality of scrapers arranged in a lattice, and each scraper of the plurality of scrapers is arranged to correspond to a different cathode rod.

11 Claims, 6 Drawing Sheets

(56) References Cited

U.S. PATENT DOCUMENTS

| | | | | |
|---|---|---|---|---|
| 4,073,703 | A | 2/1978 | Kinosz | |
| 4,148,392 | A | 4/1979 | Larson et al. | |
| 4,203,531 | A | 5/1980 | Reichel et al. | |
| 4,326,937 | A | 4/1982 | Neumeier et al. | |
| 4,437,968 | A * | 3/1984 | Elliott, Jr. | 204/600 |
| 4,492,621 | A | 1/1985 | Stubb | |
| 4,668,353 | A | 5/1987 | Smith et al. | |
| 4,851,098 | A | 7/1989 | Kimura et al. | |
| 4,863,580 | A | 9/1989 | Epner | |
| 4,880,506 | A | 11/1989 | Ackerman et al. | |
| 4,946,026 | A | 8/1990 | Rickman | |
| 5,015,342 | A | 5/1991 | Ginatta et al. | |
| 5,415,742 | A | 5/1995 | La Camera et al. | |
| 5,454,914 | A | 10/1995 | Gay | |
| 5,531,868 | A | 7/1996 | Miller et al. | |
| 5,582,706 | A | 12/1996 | Grantham et al. | |
| 5,689,538 | A | 11/1997 | Bonhomme | |
| 5,770,034 | A | 6/1998 | Jansen et al. | |
| 5,855,749 | A | 1/1999 | Kohut et al. | |
| 5,935,394 | A | 8/1999 | Sivilotti et al. | |
| 6,142,291 | A | 11/2000 | Schulze et al. | |
| 6,540,902 | B1 | 4/2003 | Redey et al. | |
| 6,689,260 | B1 | 2/2004 | Ahluwalia et al. | |
| 6,821,405 | B1 | 11/2004 | Marttila | |
| 6,866,768 | B2 | 3/2005 | Bradford et al. | |
| 7,011,736 | B1 | 3/2006 | Miller et al. | |
| 7,090,760 | B2 | 8/2006 | Seo et al. | |
| 7,097,747 | B1 | 8/2006 | Herceg et al. | |
| 7,449,635 | B2 | 11/2008 | Wiant | |
| 7,563,982 | B2 | 7/2009 | Kimmel | |
| 7,638,026 | B1 | 12/2009 | Willit et al. | |
| 7,799,185 | B1 | 9/2010 | Willit | |
| 8,248,760 | B2 | 8/2012 | Abrahamsen et al. | |
| 2004/0007466 | A1 | 1/2004 | Seo et al. | |
| 2004/0134785 | A1 | 7/2004 | Gay et al. | |
| 2004/0168932 | A1 | 9/2004 | Wang | |
| 2005/0067291 | A1 | 3/2005 | Haiki | |
| 2005/0205428 | A1 | 9/2005 | Dees et al. | |
| 2005/0233634 | A1 | 10/2005 | Kollmann | |
| 2006/0067291 | A1 | 3/2006 | Nakata | |
| 2006/0091017 | A1 * | 5/2006 | Lam | 205/102 |
| 2006/0096853 | A1 | 5/2006 | King | |
| 2007/0082551 | A1 | 4/2007 | Oesterhaus | |
| 2007/0295601 | A1 | 12/2007 | Bayer | |
| 2008/0128270 | A1 | 6/2008 | Hiraiwa et al. | |
| 2008/0142374 | A1 * | 6/2008 | Iwama et al. | 205/574 |
| 2008/0152270 | A1 | 6/2008 | Engesser et al. | |
| 2009/0050483 | A1 | 2/2009 | Li | |
| 2009/0152124 | A1 | 6/2009 | Ashford et al. | |
| 2010/0276259 | A1 | 11/2010 | Phalen | |
| 2011/0100328 | A1 | 5/2011 | Paul | |
| 2011/0180409 | A1 | 7/2011 | Willit | |

FOREIGN PATENT DOCUMENTS

| | | | |
|---|---|---|---|
| DE | 26 00 344 | | 7/1977 |
| DE | 3837572 | | 5/1989 |
| DE | 19845258 | | 3/2000 |
| EP | 0286092 | A1 | 10/1988 |
| EP | 0 736 929 | | 10/1996 |
| EP | 2224542 | | 9/2010 |
| GB | 284678 | | 11/1928 |
| GB | 506590 | | 5/1939 |
| GB | 516775 | | 1/1940 |
| JP | H05 279687 | A | 10/1993 |
| JP | H0972991 | | 3/1997 |
| JP | 2006-308442 | | 11/2006 |
| WO | WO 02/066709 | | 8/2002 |
| WO | WO 2004/018737 | | 3/2004 |
| WO | WO 2004/031453 | | 4/2004 |
| WO | WO 2005/035404 | | 4/2005 |
| WO | WO 2006/007863 | | 1/2006 |
| WO | WO 2009/062005 | | 5/2009 |
| WO | WO 2010/080761 | | 7/2010 |

OTHER PUBLICATIONS

International Search Report dated Jan. 30, 2012 issued in PCT/US2011/053878.

International Search Report dated Feb. 6, 2012 issued in PCT/US2011/053872.

International Search Report dated May 11, 2012 issued in PCT/US2011/053871.

Jeong et al., "Electrolytic production of metallic Uranium from U3O8 in a 20-kg batch scale reactor", Journal of Radioanalytical and Nuclear Chemistry, vol. 268, No. 2 (2006) pp. 349-356.

International Search Report and Written Opinion issued in International Patent Application No. PCT/US2012/058664, mailed Jul. 8, 2013.

International Search Report and Written Opinion issued in International Patent Application No. PCT/US2012/058659, mailed Jul. 5, 2013.

"Electrolytic Reduction of Spent Oxide Fuel-Bench-Scale Test Results", Steven D. Herman, Shelly X. Li, Michael F. Simpson.

Search Report ans Written Opinion from corresponding PCT Application No. PCT/US2012/058661, dated Jul. 25, 2013.

Figueroa, J. et al., "GTRI Progress in Developing Pyrochemical Processes for Recovery of Fabrication Scrap and Reprocessing of Monolithic U-MO Fuel", RERTR 2011—International Meeting on Reduced Enrichment for Research and Test Reactors, Oct. 23, 2011, XP055071122.

International Search Report and Written Opinion issued in International Patent Application No. PCT/US2012/058663, issued Aug. 12, 2013.

International Search Report and Written Opinion issued in International Patent Application No. PCT/2012/058531, issued Aug. 2, 2013.

European Search Report issued in European Patent Application No. 13163951.0, issued Aug. 29, 2013.

"Proceedings of GLOBAL 2005", Tsukuba, Japan, Oct. 9-13, 2005, Paper No. 488, three pages total.

Journeau, et al., "Physico-chemical analyses and solidification path reconstruction of multi-component oxidic spread melts." Materials Science and Engineering A. vol. 299. Feb. 15, 2001. pp. 249-266.

International Atomic Energy Agency (IAEA). "Storage and Disposal of Spent Fuel and High Level Radioactive Waste". Additional paper to the IAEA's Nuclear Technology Review (2006), pp. 1-11.

Morss, et al., "Cerium, uranium, and plutonium behavior in glass-bonded sodalite, a ceramic nuclear waste form." Journal of Alloys and Compounds. vols. 303-304. May 24, 2000. pp. 42-48.

Abraham, et al., "Metal waste forms from treatment of EBR-II spent fuel." Argonne National Laboratory. Presented at Spectrum '98 Conference. Sep. 18, 1998, pp. 1-7.

* cited by examiner

CATHODE SCRAPER SYSTEM AND METHOD OF USING THE SAME FOR REMOVING URANIUM

GOVERNMENT SUPPORT

This invention was made with Government support under contract number DE-ACO2-06CH11357, awarded by the U.S. Department of Energy. The Government has certain rights in the invention.

BACKGROUND

An electrochemical process may be used to recover metals from an impure feed and/or to extract metals from a metal-oxide. A conventional process (for soluble metal oxides) typically involves dissolving a metal-oxide in an electrolyte followed by electrolytic decomposition or (for insoluble metal oxides) selective electrotransport to reduce the metal-oxide to its corresponding metal. Conventional electrochemical processes for reducing insoluble metal-oxides to their corresponding metallic state may employ a single step or multiple-step approach.

A multiple-step approach may be a two-step process that utilizes two separate vessels. For example, the extraction of uranium from the uranium oxide of spent nuclear fuels includes an initial step of reducing the uranium oxide with lithium dissolved in a molten LiCl electrolyte so as to produce uranium metal and $Li_2O$ in a first vessel, wherein the $Li_2O$ remains dissolved in the molten LiCl electrolyte. The process then involves a subsequent step of electrowinning in a second vessel, wherein the dissolved $Li_2O$ in the molten LiCl is electrolytically decomposed to form oxygen and regenerate lithium. Consequently, the resulting uranium metal may be extracted in an electrorefining process, while the molten LiCl with the regenerated lithium may be recycled for use in the reduction step of another batch.

However, a multi-step approach involves a number of engineering complexities, such as issues pertaining to the transfer of molten salt and reductant at high temperatures from one vessel to another. Furthermore, the reduction of oxides in molten salts may be thermodynamically constrained depending on the electrolyte-reductant system. In particular, this thermodynamic constraint will limit the amount of oxides that can be reduced in a given batch. As a result, more frequent transfers of molten electrolyte and reductant will be needed to meet production requirements.

On the other hand, a single-step approach generally involves immersing a metal oxide in a compatible molten electrolyte together with a cathode and anode. By charging the anode and cathode, the metal oxide (which is in electrical contact with the cathode) can be reduced to its corresponding metal through electrolytic conversion and ion exchange through the molten electrolyte. However, although a conventional single-step approach may be less complex than a multi-step approach, the yield of the metallic product is relatively low. Furthermore, the metallic product still contains unwanted impurities.

SUMMARY

Embodiments include a cathode scraper system and/or method of using the same for removing uranium useable in an electrorefining system.

The cathode scraper system includes a plurality of cathode assemblies. Each cathode assembly includes a plurality of cathode rods. The cathode scraper system also includes a cathode scraper assembly configured to remove purified uranium deposited on the plurality of cathode rods. The cathode scraper assembly includes a plurality of scrapers arranged in a lattice, and each scraper of the plurality of scrapers is arranged to correspond to a different cathode rod.

In one embodiment, the plurality of cathode rods have the same orientation and are arranged so as to be within the same plane. The plurality of scrapers are arranged into rows of scrapers, and each row corresponds to a different cathode assembly.

The cathode scraper assembly includes a first support bar that is connected to first ends of the rows of scrapers and a second support bar that is connected to second ends of the rows of scrapers. Each scraper includes an outer structure and a hollow center, and the hollow center is dimensioned such that a corresponding cathode rod fits into the hollow center permitting the outer structure to remove the purified uranium. In one embodiment, the outer structure includes an angled top portion and an angled bottom portion so as to facilitate removal of the purified uranium.

The cathode scraper system may further include a mechanism configured to move the cathode scraper assembly along the plurality of cathode rods. The mechanism may move the cathode scraper assembly from a first position to a second position. The first position is located at a top portion of the plurality of cathode rods, and the second position is located at a bottom portion of the plurality of cathode rods.

In one embodiment, the mechanism includes a plurality of motors and gearboxes configured to move the cathode scraper assembly from the first position to the second position along a set of screws. Each screw of the set being positioned at a corner of the cathode scraper assembly and extending in a same direction as the plurality of cathode rods.

The method includes removing, by a cathode scraper assembly, the purified uranium that has been deposited on the plurality of cathode rods. The cathode scraper assembly includes a plurality of scrapers arranged in a lattice, and each scraper of the plurality of scrapers is arranged to correspond to a different cathode rod.

In one embodiment, the removing step further includes moving, by a mechanism, the cathode scraper assembly along the plurality of cathode rods. The moving step moves the cathode scraper assembly from a first position to a second position. The first position is located at a top portion of the plurality of cathode rods, and the second position is located at a bottom portion of the plurality of cathode rods.

DETAILED DESCRIPTION

Figure 1:
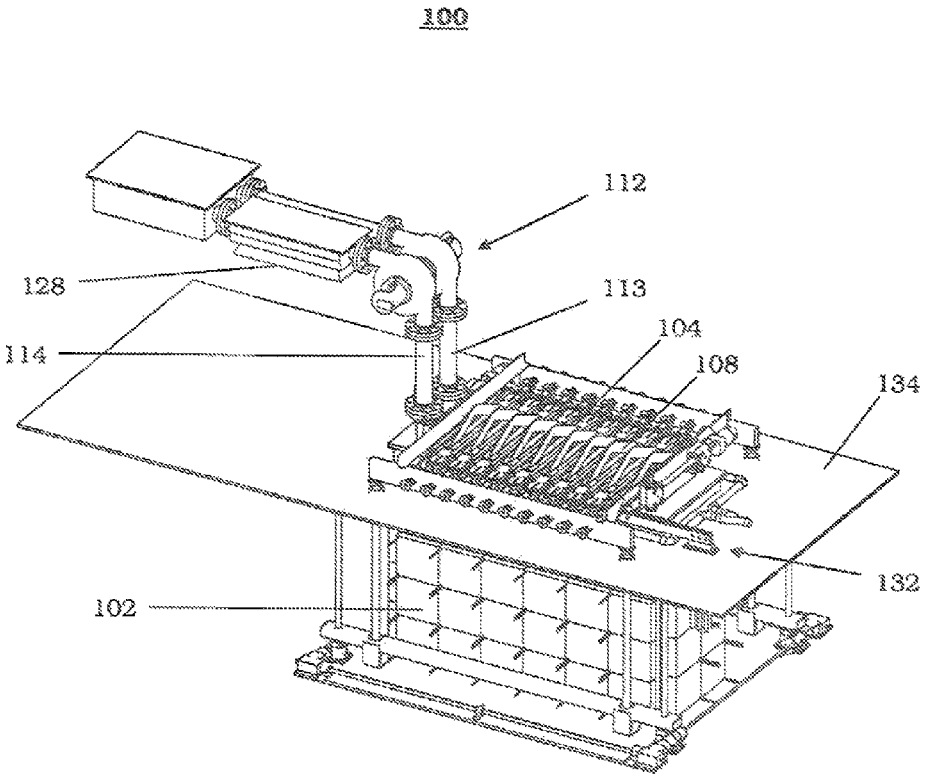
FIG. 1 is a perspective view of an electrorefiner system including a cathode power distribution system according to an example embodiment.

Hereinafter, example embodiments will be described in detail with reference to the attached drawings. However, specific structural and functional details disclosed herein are merely representative for purposes of describing example embodiments. The example embodiments may be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures or described in the specification. For example, two figures or steps shown in succession may in fact be executed in series and concurrently or may sometimes be executed in the reverse order or repetitively, depending upon the functionality/acts involved.

An electrorefiner system according to a non-limiting embodiment may be used to recover a purified metal (e.g., uranium) from a relatively impure nuclear feed material (e.g., impure uranium feed material). The electrorefiner system may be as described in U.S. application Ser. No. 13/335,082, HDP Ref. 8564-000252/US, GE Ref. 24NS250931, filed on even date herewith, titled "ELECTROREFINER SYSTEM FOR RECOVERING PURIFIED METAL FROM IMPURE NUCLEAR FEED MATERIAL," the entire contents of which are incorporated herein by reference. The impure nuclear feed material may be a metallic product of an electrolytic oxide reduction system. The electrolytic oxide reduction system may be configured to facilitate the reduction of an oxide to its metallic form so as to permit the subsequent recovery of the metal. The electrolytic oxide reduction system may be as described in U.S. application Ser. No. 12/978,027, filed Dec. 23, 2010, "ELECTROLYTIC OXIDE REDUCTION SYSTEM," HDP Ref.: 8564-000228/ US, GE Ref.: 24AR246140, the entire contents of which is incorporated herein by reference.

Generally, the electrorefiner system may include a vessel, a plurality of cathode assemblies, a plurality of anode assemblies, a power system, a scraper, and/or a conveyor system. The power system for the electrorefiner system may include a common bus bar for the plurality of cathode assemblies. The power system may be as described in U.S. application Ser. No. 13/335,121, HDP Ref. 8564-000254/US, GE Ref. 24AR252783, filed on even date herewith, titled "CATHODE POWER DISTRIBUTION SYSTEM AND METHOD OF USING THE SAME FOR POWER DISTRIBUTION," the entire contents of which are incorporated herein by reference. Power may be supplied to the common bus bar through a floor structure via an electrical feedthrough unit. The electrical feedthrough unit may be as described in U.S. application Ser. No. 13/335,139, HDP Ref. 8564-000253/US, GE Ref. 24AR252782, filed on even date herewith, titled "BUS BAR ELECTRICAL FEEDTHROUGH FOR ELECTROREFINER SYSTEM," the entire contents of which are incorporated herein by reference.

The scraper is further described with reference to FIGS. 3-6 of the present disclosure. The conveyor system may be as described in U.S. application Ser. No. 13/335,140, HDP Ref. 8564-000260/US, GE Ref. 24AR256355, filed on even date herewith, titled "CONTINUOUS RECOVERY SYSTEM FOR ELECTROREFINER SYSTEM," the entire contents of which are incorporated herein by reference. However, it should be understood that the electrorefiner system is not limited thereto and may include other components that may not have been specifically identified herein. Furthermore, the electrorefiner system and/or electrolytic oxide reduction system may be used to perform a method for corium and used nuclear fuel stabilization processing. The method may be as described in U.S. application Ser. No. 13/453,290, HDP Ref. 8564-000262/US, GE Ref. 24AR253193, filed on Apr.23, 2012, titled "METHOD FOR CORIUM AND USED NUCLEAR FUEL STABILIZATION PROCESSING," the entire contents of which are incorporated herein by reference.

As noted above, the impure nuclear feed material for the electrorefiner system may be a metallic product of an electrolytic oxide reduction system. During the operation of an electrolytic oxide reduction system, a plurality of anode and cathode assemblies are immersed in a molten salt electrolyte. In a non-limiting embodiment of the electrolytic oxide reduction system, the molten salt electrolyte may be lithium chloride (LiCl). The molten salt electrolyte may be maintained at a temperature of about 650° C. (+50° C., −30° C.). An electrochemical process is carried out such that a reducing potential is generated at the cathode assemblies, which contain the oxide feed material (e.g., metal oxide). Under the influence of the reducing potential, the metal ion of the metal oxide is reduced to metal and the oxygen (O) from the metal oxide (MO) feed material dissolves into the molten salt electrolyte as an oxide ion, thereby leaving the metal (M) behind in the cathode assemblies. The cathode reaction may be as follows:

$$MO+2e^{-}\rightarrow M+O^{2-}$$

At the anode assemblies, the oxide ion is converted to oxygen gas. The anode shroud of each of the anode assemblies may be used to dilute, cool, and remove the oxygen gas from the electrolytic oxide reduction system during the process. The anode reaction may be as follows:

$$O^{2-}\rightarrow \tfrac{1}{2}O_2+2e^{-}$$

The metal oxide may be uranium dioxide ($UO_2$), and the reduction product may be uranium metal. However, it should be understood that other types of oxides may also be reduced to their corresponding metals with the electrolytic oxide reduction system. Similarly, the molten salt electrolyte used in the electrolytic oxide reduction system is not particularly limited thereto and may vary depending of the oxide feed material to be reduced.

After the electrolytic oxide reduction, the basket containing the metallic product in the electrolytic oxide reduction system is transferred to the electrorefiner system according to the example embodiments for further processing to obtain a purified metal from the metallic product. Stated more clearly, the metallic product from the electrolytic oxide reduction system will serve as the impure nuclear feed material for the electrorefiner system according to the example embodiments. Notably, while the basket containing the metallic product is a cathode assembly in the electrolytic oxide reduction system, the basket containing the metallic product is an anode assembly in the electrorefiner system. Compared to prior art apparatuses, the electrorefiner system according to the example embodiments allows for a significantly greater yield of purified metal.

Figure 2:
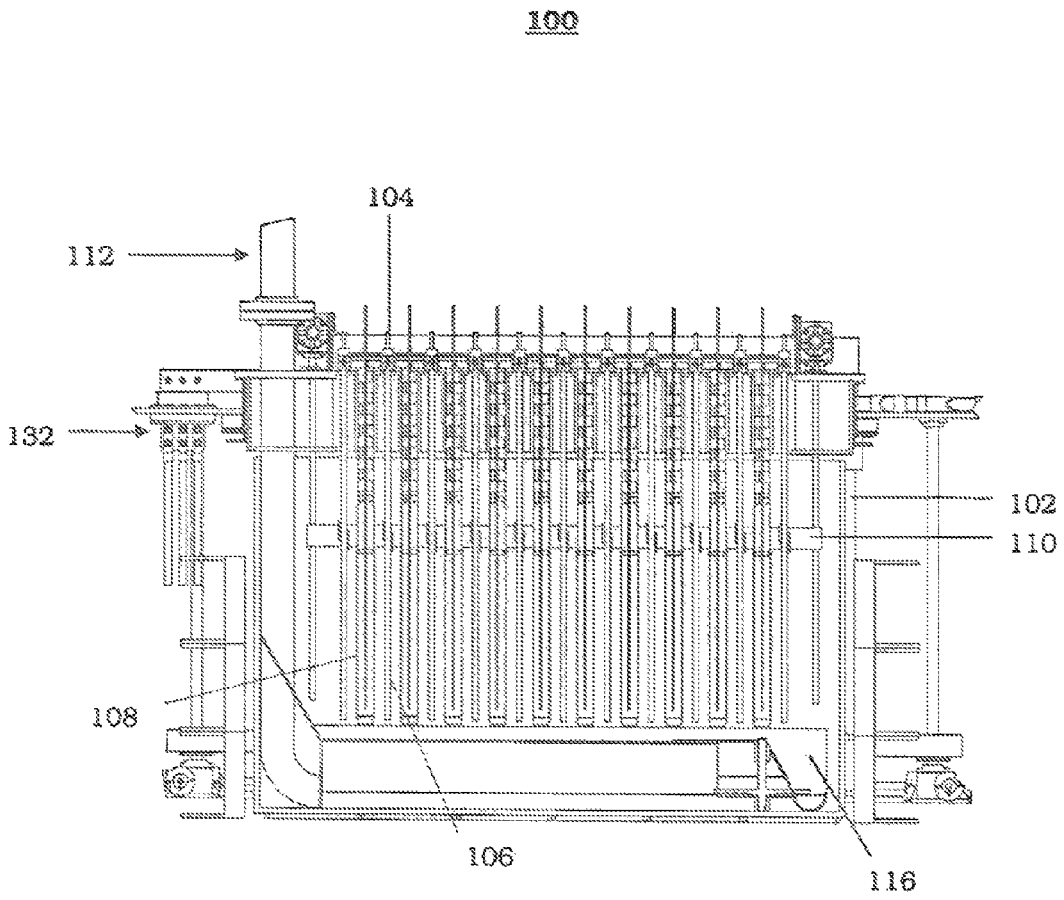
FIG. 2 is a cross-sectional side view of an electrorefiner system including a cathode power distribution system according to an example embodiment.

FIG. 1 is a perspective view of an electrorefiner system including a cathode scraper system according to a non-limiting embodiment. FIG. 2 is a cross-sectional side view of an electrorefiner system including a cathode scraper system according to a non-limiting embodiment.

Referring to FIGS. 1-2, the electrorefiner system 100 includes a vessel 102, a plurality of cathode assemblies 104, a plurality of anode assemblies 108, a power system, a scraper 110 (e.g., a cathode scraper assembly), and/or a conveyor system 112. Each of the plurality of cathode assemblies 104 may include a plurality of cathode rods 106. The power system may include an electrical feedthrough unit 132 that extends through the floor structure 134. The floor structure 134 may be a glovebox floor in a glovebox. Alternatively, the floor structure 134 may be a support plate in a hot-cell facility. The conveyor system 112 may include an inlet pipe 113, a trough 116, a chain, a plurality of flights, an exit pipe 114, and/or a discharge chute 128.

The vessel 102 is configured to maintain a molten salt electrolyte. In a non-limiting embodiment, the molten salt electrolyte may be LiCl, a LiCl-KCl eutectic, or another suitable medium. The vessel 102 may be situated such that a majority of the vessel 102 is below the floor structure 134. For instance, an upper portion of the vessel 102 may extend above the floor structure 134 through an opening in the floor structure 134. The opening in the floor structure 134 may correspond to the dimensions of the vessel 102. The vessel 102 is configured to receive the plurality of cathode assemblies 104 and the plurality of anode assemblies 108.

The plurality of cathode assemblies 104 are configured to extend into the vessel 102 so as to at least be partially submerged in the molten salt electrolyte. For instance, the dimensions of the plurality of cathode assemblies 104 and/or the vessel 102 may be adjusted such that the majority of the length of the plurality of cathode assemblies 104 is submerged in the molten salt electrolyte in the vessel 102. Each cathode assembly 104 may include a plurality of cathode rods 106 having the same orientation and arranged so as to be within the same plane.

The plurality of anode assemblies 108 may be alternately arranged with the plurality of cathode assemblies 104 such that each anode assembly 108 is flanked by two cathode assemblies 104. The plurality of cathode assemblies 104 and anode assemblies 108 may be arranged in parallel. Each anode assembly 108 may be configured to hold and immerse an impure uranium feed material in the molten salt electrolyte maintained by the vessel 102. The dimensions of the plurality of anode assemblies 108 and/or the vessel 102 may be adjusted such that the majority of the length of the plurality of anode assemblies 108 is submerged in the molten salt electrolyte in the vessel 102. Although the electrorefiner system 100 is illustrated in FIGS. 1-2 as having eleven cathode assemblies 104 and ten anode assemblies 108, it should be understood that the example embodiments herein are not limited thereto.

In the electrorefiner system 100, a cathode power distribution system is connected to the plurality of cathode assemblies 104 and anode assemblies 108.

To initiate the removal of the purified uranium, the cathode scraper assembly 110 is configured to move up and down along the length of the plurality of cathode rods 106 to dislodge the purified uranium deposited on the plurality of cathode rods 106 of the plurality of cathode assemblies 104. As a result of the scraping, the dislodged purified uranium sinks through the molten salt electrolyte to the bottom of the vessel 102. The cathode scraper assembly 110 is further described with reference to FIGS. 3-6.

The conveyor system 112 is configured such that at least a portion of it is disposed at the bottom of the vessel 102. For example, the trough 116 of the conveyor system 112 may be disposed at the bottom of the vessel 102 such that the purified uranium dislodged from the plurality of cathode rods 106 accumulates in the trough 116. The conveyor system 112 is configured to transport the purified uranium accumulated in the trough 116 through an exit pipe 114 to a discharge chute 128 so as to remove the purified uranium from the vessel 102.

Figure 3:
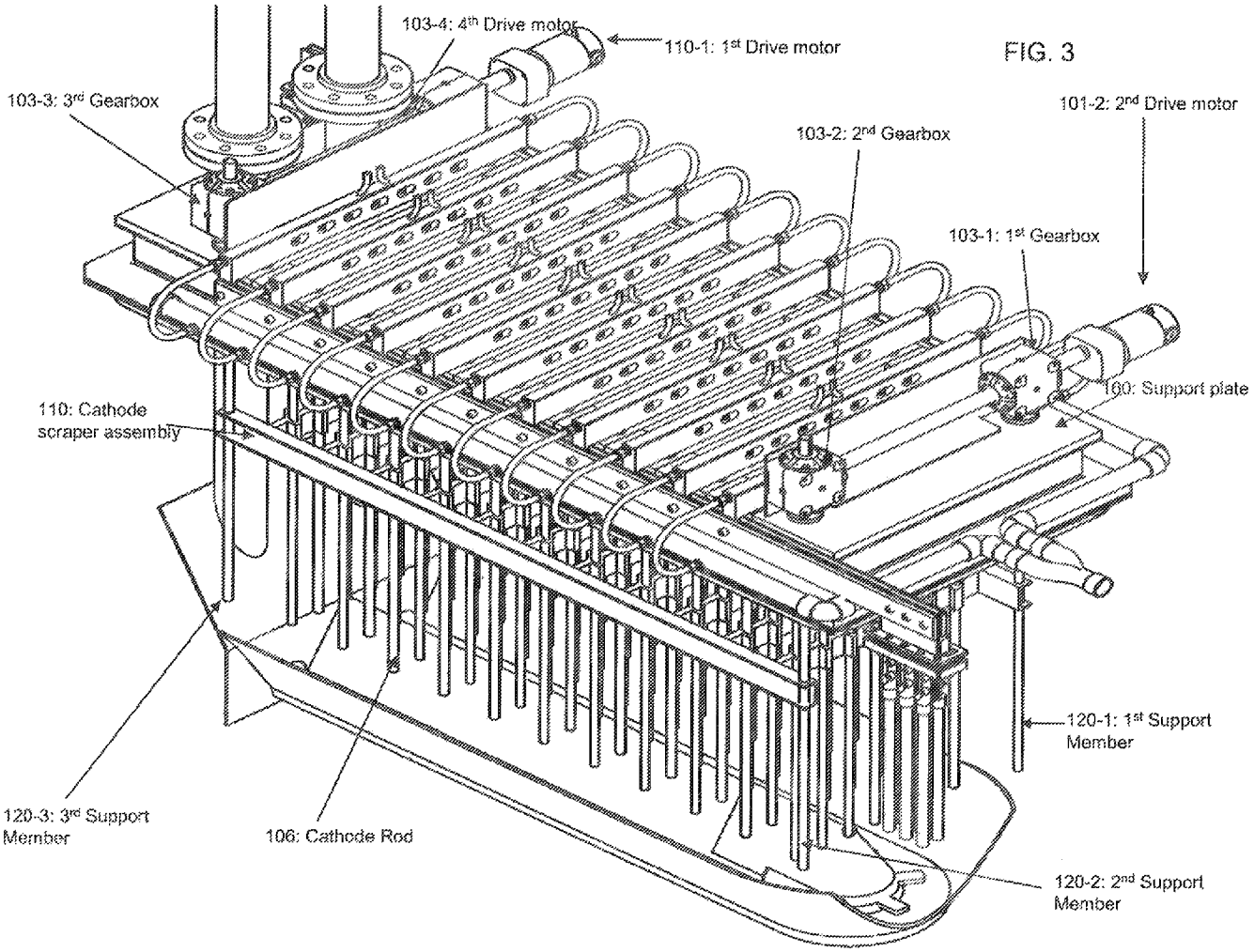
FIG. 3 illustrates the electrorefining system of FIGS. 1-2 including a cathode scraper system according to an example embodiment.

FIG. 3 illustrates the electrorefining system of FIGS. 1-2 including the cathode scraper system according to an example embodiment.

The cathode scraper system includes the cathode scraper assembly 110 and a drive mechanism. The cathode scraper assembly 110 includes a plurality of scrapers (e.g., 107 in FIGS. 4-6), where each scraper corresponds to a different cathode rod 106 in the cathode assemblies 104. The details of the cathode scraper assembly 110 are further detailed in FIG. 4. The drive mechanism includes a plurality of drive motors 101, a plurality of gearboxes 103, and a set of support members 120, where the plurality of drive motors 101 drive the cathode scraper assembly 110 along the set of support members 120, thereby scraping the purified uranium from the cathode rods 106.

The plurality of drive motors 101 includes a first motor 101-1 and a second motor 101-2, and the plurality of gearboxes 103 include a first gearbox 103-1, a second gearbox 103-2, a third gearbox 103-3, and a fourth gearbox 103-4. Each gearbox 103 corresponds to a different corner of the cathode scraper assembly 110. The set of support members 120 includes a first support member 120-1, a second support member 120-2, a third support member 120-3 and a fourth support member (not shown). The plurality of motors 101 and gearboxes 103 are configured above the support plate 160 and are connected to the set of support members 120. For example, the first gearbox 103-1 is connected to the first support member 120-1, the second gearbox 103-2 is connected to the second support member 120-2, the third gearbox 103-3 is connected to the third support member 120-3, and the fourth gearbox 103-4 is connected to the fourth support member. Each corner of the cathode scraper assembly 110 includes a hole that is dimensioned to fit and support a respective support member 120. The set of support members 120 is parallel to the cathode rods 106. In one embodiment, each support member 120 may be a screw.

Each motor 101 is synchronized with the other and the rotation of the corresponding gearbox 103 and support member 120, thereby driving the cathode scraper assembly 110 from a first position to a second position (and vice versa). The first position may be located at a top portion of the cathode rods 106, and the second position may be located at a bottom portion of the cathode rods 106. As such, the driving mechanism moves the cathode scraper assembly 110 along the cathode rods 106.

Figure 4:
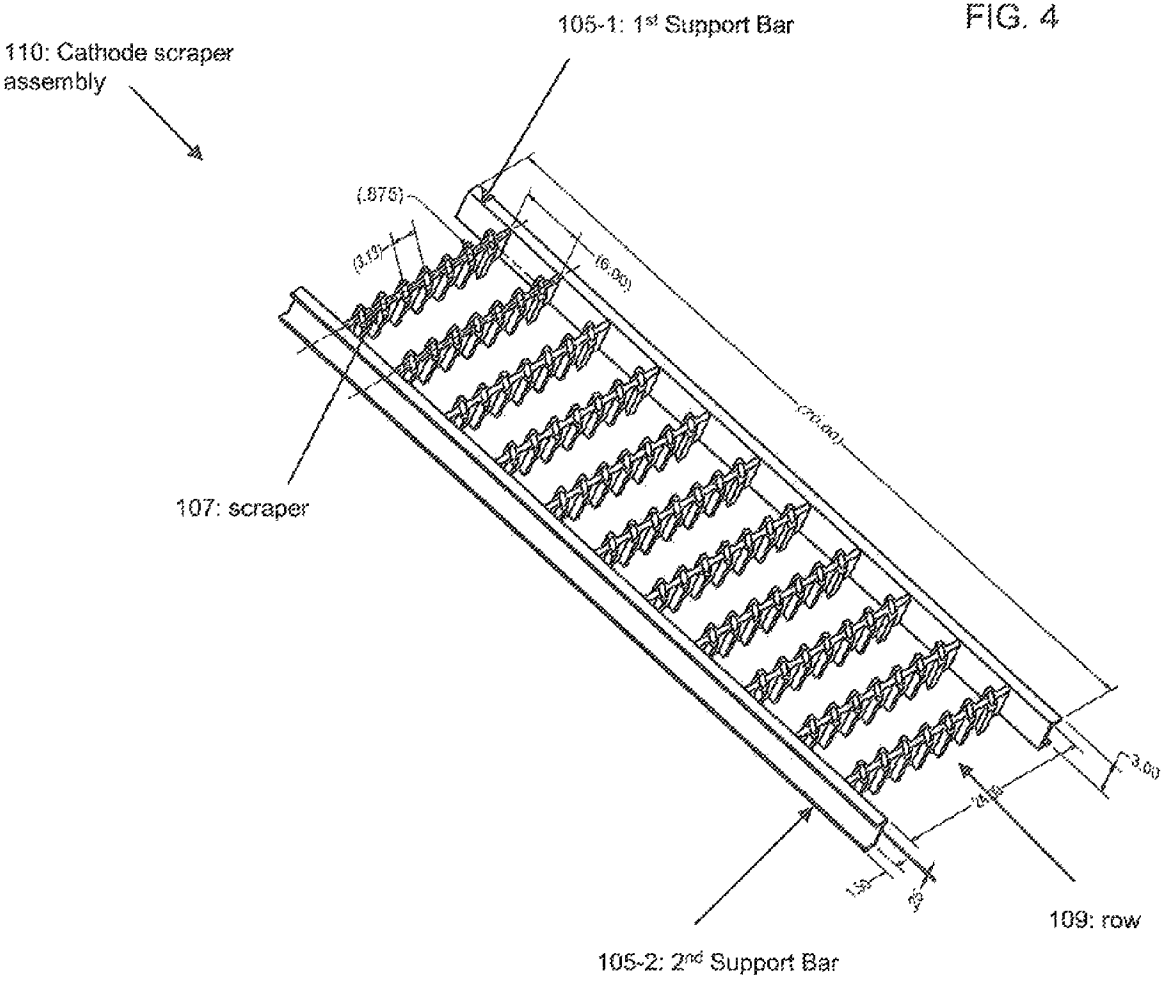
FIG. 4 illustrates a cathode scraper assembly of the cathode scraper system according to an example embodiment.

FIG. 4 illustrates the cathode scraper assembly 110 of the cathode scraper system according to an example embodiment. The cathode scraper assembly 100 includes a plurality of scrapers 107 that are arranged in a lattice, and a plurality of support bars 105 that are configured to support the plurality of scrapers 107. Each scraper 107 is arranged to correspond to a different cathode rod 106. For example, the plurality of scrapers 107 includes a number of rows 109 of scrapers 107. Each row 109 corresponds to a different cathode assembly 104, and includes a number of scrapers 107. The number of rows 109 and the number of scrapers 107 in each row may be any integer greater or equal to two. The plurality of support bars 105 includes a first support bar 105-1 and a second support bar 105-2. The first support bar 105-1 is connected to first ends of the rows 109 of the scrapers 107, and the second support bar 105-2 is connected to second ends of the rows 109 of the scrapers 107.

Figure 5:
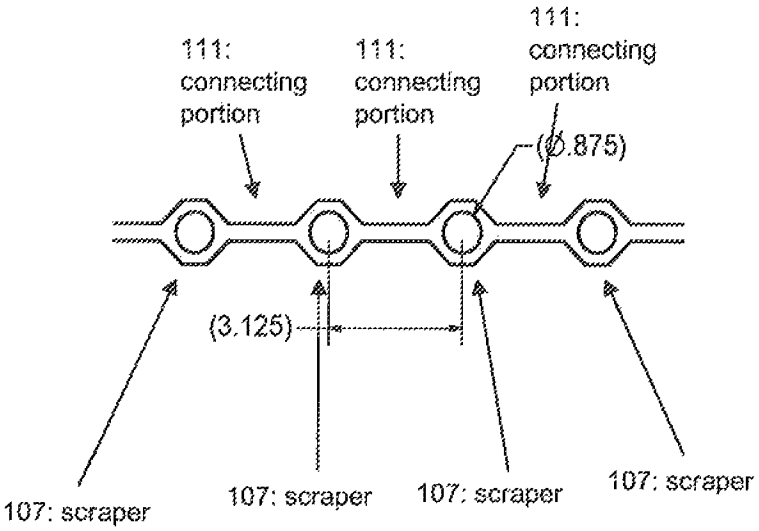
FIG. 5 illustrates a top view of a scraper of the cathode scraper assembly according to an example embodiment.

FIG. 5 illustrates a top view of the scrapers 107 of the cathode scraper assembly 110 according to an example embodiment. As shown in FIG. 5, each scraper 107 includes an outer structure and a hollow center, and the hollow center is dimensioned such that a corresponding cathode rod 106 fits into the hollow center permitting the outer structure to remove the purified uranium. Within each row 109, the scrapers 107 are connected via connecting portions 111, which is the same material as the scrapers 107. The spacing between adjacent scrapers 107 within a row 109 may correspond to the spacing between adjacent cathode rods 106 within a respective cathode assembly 104. In one embodiment, for each row 109, the outer structure of the scrapers 107 and the connecting portions 111 form a continuous structure, and the ends of the continuous structure are connected to the first support bar 105-1 and the second support bar 105-2.

Figure 6:
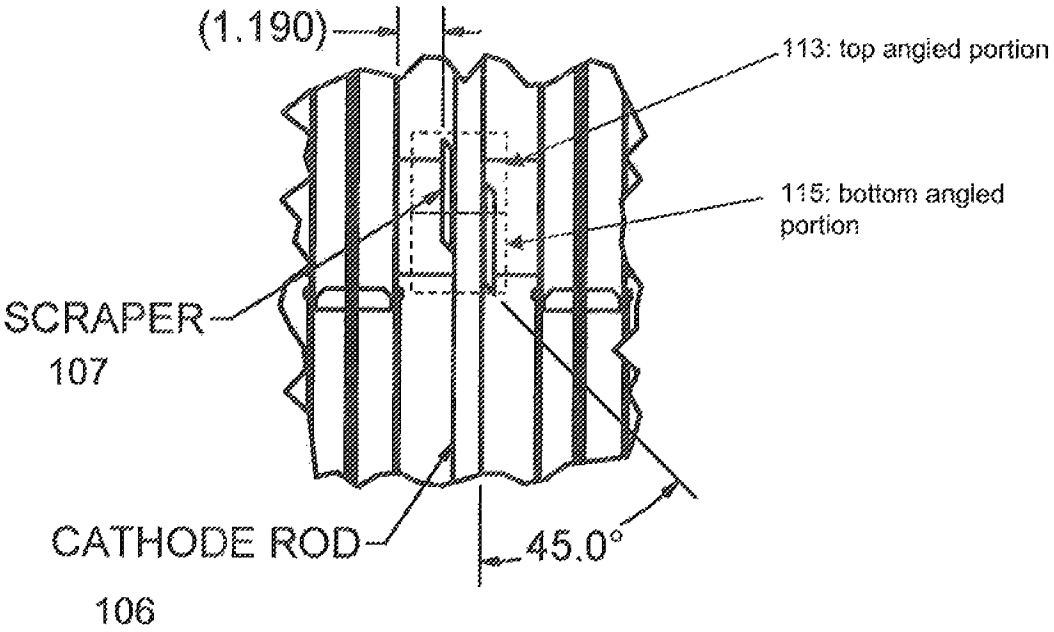
FIG. 6 illustrates a side view of the scraper of the cathode scraper assembly according to an example embodiment.

FIG. 6 illustrates a side view of the scraper 107 of the cathode scraper assembly 110 according to an example embodiment. Referring to FIG. 6, the scraper 107 includes an angled top portion 113 and an angled bottom portion 115. For example, within a row 109, each scraper 107 is aligned to be within the same plane, and a corresponding cathode rod 106 passes through the hollow center. The top portion of the outer structure of the scraper 107 on one side of the cathode rod 106 is offset from the top portion of the outer structure of the scraper 107 on the other side of the cathode rod 106, thereby creating the angled top portion 113. In one embodiment, the top portion 113 may be angled at 45 degrees from an axis of the cathode rod 106. However, the degrees from which the top portion 113 is angled may encompass any type of value. Similarly, the bottom portion of the outer structure of the scraper 107 on one side of the cathode rod 106 is offset from the bottom portion on the other side of the cathode rod 106, thereby creating the angled bottom portion 115. In one embodiment, the bottom portion 115 may be angled at 45 degrees from an axis of the cathode rod 106. However, the degrees from which the bottom portion 115 is angled may encompass any type of value. The angling of the top and bottom portions of the outer structure facilitates the removal of uranium from the cathode rods 106 and eliminates material build-up on the cathode scraper assembly 110.

Example embodiments thus being described, it will be appreciated by one skilled in the art that example embodiments may be varied through routine experimentation and without further inventive activity. For example, although electrical contacts are illustrated in example embodiments at one side of an example refining system, it is of course understood that other numbers and configurations of electrical contacts may be used based on expected cathode and anode assembly placement, power level, necessary anodizing potential, etc. Variations are not to be regarded as departure from the spirit and scope of the example embodiments, and all such modifications as would be obvious to one skilled in the art are intended to be included within the scope of the following claims.

What is claimed is:

1. A cathode scraper system, comprising:

a plurality of cathode assemblies, each cathode assembly of the plurality of cathode assemblies including a plurality of cathode rods; and a cathode scraper assembly configured to remove purified uranium deposited on the plurality of cathode rods, the cathode scraper assembly including rows of a plurality of scrapers and connecting portions alternately arranged with the plurality of scrapers, each scraper of the plurality of scrapers being in a form of a sleeve configured to receive a different cathode rod of the plurality of cathode rods, the connecting portions being thinner than the plurality of scrapers so as to provide recessed regions between the plurality of scrapers, the plurality of scrapers of a same row having at least one of angled top surfaces and angled bottom surfaces defined by a common plane.

2. The cathode scraper system of claim 1, wherein the plurality of cathode rods have a same orientation and are arranged so as to be within a same plane.

3. The cathode scraper system of claim 1, wherein each of the rows corresponds to a different cathode assembly of the plurality of cathode assemblies.

4. The cathode scraper system of claim 3, wherein the cathode scraper assembly includes a first support bar that is connected to first ends of the rows of scrapers and a second support bar that is connected to second ends of the rows of scrapers.

5. The cathode scraper system of claim 1, further comprising:

a drive mechanism configured to move the cathode scraper assembly along the plurality of cathode rods.

6. The cathode scraper system of claim 5, wherein the drive mechanism moves the cathode scraper assembly from a first position to a second position, the first position being located at a top portion of the plurality of cathode rods, the second position being located at a bottom portion of the plurality of cathode rods.

7. The cathode scraper system of claim 6, wherein the drive mechanism includes:

a plurality of motors and gearboxes configured to move the cathode scraper assembly from the first position to the second position along a set of screws, each screw of the set being positioned at a corner of the cathode scraper assembly and extending in a same direction as the plurality of cathode rods.

8. The cathode scraper system of claim 1, wherein the angled top surfaces and the angled bottom surfaces are defined by parallel planes.

9. A method for removing purified uranium deposited from a plurality of cathode assemblies, each cathode assembly of the plurality of cathode assemblies including a plurality of cathode rods, the method comprising:

removing, by a cathode scraper assembly, the purified uranium that has been deposited on the plurality of cathode rods, the cathode scraper assembly including rows of a plurality of scrapers and connecting portions alternately arranged with the plurality of scrapers, each scraper of the plurality of scrapers being in a form of a sleeve configured to receive a different cathode rod of the plurality of cathode rods, the connecting portions being thinner than the plurality of scrapers so as to provide recessed regions between the plurality of scrapers, the plurality of scrapers of a same having at least one of angled top surfaces and angled bottom surfaces defined by a common plane.

10. The method of claim 9, wherein the removing step further includes:

moving, by a drive mechanism, the cathode scraper assembly along the plurality of cathode rods.

11. The method of claim 10, wherein the moving step moves the cathode scraper assembly from a first position to a second position, the first position being located at a top portion of the plurality of cathode rods, the second position being located at a bottom portion of the plurality of cathode rods.

* * * * *